US006240194B1

(12) United States Patent
De Koning

(10) Patent No.: US 6,240,194 B1
(45) Date of Patent: May 29, 2001

(54) HEARING AID WITH EXTERNAL FREQUENCY CONTROL

(75) Inventor: Lambertus F. M. De Koning, Wijchen (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/015,881

(22) Filed: Jan. 29, 1998

(30) Foreign Application Priority Data

Jul. 18, 1997 (WO) ..... PCT/IB97/00901

(51) Int. Cl.[7] ..... H04R 25/00
(52) U.S. Cl. ..... 381/315; 381/312
(58) Field of Search ..... 381/312, 315, 381/314, 320, 321, 323, 60; 73/585; 455/265, 255, 362; 331/57

(56) References Cited

U.S. PATENT DOCUMENTS 4,034,300 * 7/1977 Steckenbach .
4,959,810 * 9/1990 Darbee et al. .
5,012,520 * 4/1991 Steeger .
5,083,312 * 1/1992 Newton et al. .
5,563,553 * 10/1996 Jackson .
5,703,541 * 12/1997 Nakashima .
5,739,725 * 4/1998 Ferraiolo et al. .
5,835,610 * 11/1998 Ishige et al. .
5,896,069 * 4/1999 Williams et al. .

FOREIGN PATENT DOCUMENTS 4221304 9/1993 (DE) .

OTHER PUBLICATIONS

"A Single Battery, 0.9V–Operated Digital Sound Processing IC Including AD/DA and IR Receiver with 2mW Power Consumption" by Harry Neuteboom et al; ISSCC97/Session 6/Low–Power and Mixed–Signal Processing/Paper TP6.4; IEEE International Solkid–Statie Circuits Conference.

* cited by examiner

*Primary Examiner*—Stella Woo
*Assistant Examiner*—P. Dabney
(74) *Attorney, Agent, or Firm*—Bernard Franzblau

(57) ABSTRACT

A hearing aid comprises a controllable oscillator, a control circuit and a receiver for receiving a reference signal from a remote control. The control circuit is coupled to the controllable oscillator and to the receiver and is constructed so as to control the frequency of a clock signal generated by the oscillator by means of the reference signal received by the receiver.

17 Claims, 4 Drawing Sheets

HEARING AID WITH EXTERNAL FREQUENCY CONTROL

BACKGROUND OF THE INVENTION

This invention relates to a hearing aid comprising a controllable oscillator and a control circuit coupled thereto.

Such a hearing aid is disclosed in DE-C 4 221 304. Digital hearing aids require an oscillator to generate a clock signal. To obtain properly functioning hearing aids, the frequency of this clock signal must be determined in a stable and accurate manner. In general, such a stable and accurate clock signal can be obtained in a simple manner by using a crystal oscillator. However, crystal oscillators are not often used in hearing aids because of the dimensions of the crystals required by these oscillators. Instead, hearing aids are customarily provided with a controllable oscillator. In such hearing aids, the frequency of the clock signal generated by the controllable oscillator, which frequency is governed, inter alia, by voltage and temperature variations, can be regulated.

The hearing aid known from the above-mentioned German patent specification comprises a controllable oscillator and a control circuit which is coupled thereto. This control circuit comprises a memory in which a number of data words are stored. By manually selecting one specific data word from this memory, the frequency of the signal generated by the oscillator is set via a number of capacitors. However, in the known hearing aid, a fine adjustment of the oscillator frequency is not readily possible.

OBJECTS AND SUMMARY OF THE INVENTION

It is an object of the invention to provide a hearing aid of the type mentioned in the opening paragraph, in which the oscillator frequency remains substantially constant despite variations, inter alia, in the supply voltage and the temperature. To achieve this, the hearing aid in accordance with the invention is characterized in that the hearing aid further includes a receiver for receiving a reference signal from a remote control, the control circuit also being coupled to the receiver, and the control circuit being constructed so as to regulate a frequency of the oscillator by means of the reference signal received by the receiver.

By sending a reference signal generated in the remote control to the hearing aid, such a reference signal is available now in the hearing aid. By controlling the oscillator by means of the received reference signal, a substantially constant frequency of the oscillator is achieved despite variations in the supply voltage and the temperature.

The reference signal now can be generated by means of a crystal oscillator. In general, the use of a crystal in the remote control is not problematic because the space available in the remote control is generally sufficient.

An embodiment of the hearing aid in accordance with the invention is characterized in that the control circuit can be switched between at least a first and a second state, the control circuit being arranged so as to change, in the first state, the frequency in first frequency steps and, in the second state, in second frequency steps, the first frequency steps being larger than the second frequency steps. By virtue thereof, on the one hand, a frequency which differs relatively substantially from the desired frequency can be regulated relatively rapidly towards the desired value. In this case, the control circuit must be switched into the first state. On the other hand, if the frequency is already close to the desired frequency, the frequency can be accurately adjusted. In this case, the control circuit must be switched into the second state.

A further embodiment of the hearing aid in accordance with the invention is characterized in that the reference signal comprises a first sub-signal, with the control circuit being switched into the first state during reception of the first sub-signal, and, upon completion of the reception of the first sub-signal, the control circuit is switched into the second state.

The first sub-signal is selected so as to correspond to a first part of the reference signal. At the beginning of the reception of the reference signal (and hence at the beginning of the reception of the first sub-signal) it is not certain whether the frequency of the oscillator is close to the desired frequency. For this reason, during reception of the first sub-signal, the control circuit is always switched into the first state. By virtue thereof, the frequency, if it differs relatively substantially from the desired frequency, can be regulated relatively rapidly towards the desired value. Further, the length of the first sub-signal is selected so that, upon completion of the reception of the first sub-signal, the frequency is always close to the desired frequency. By virtue thereof, upon completion of the reception of the first sub-signal, it is sufficient to accurately regulate the frequency. At this stage, the control circuit is switched into the second state.

A further embodiment of the hearing aid in accordance with the invention is characterized in that the control circuit further comprises first and second memory means, the memory means being disposed so as to contain a control value corresponding to a frequency of the oscillator, and the reference signal further comprising a second sub-signal, the control circuit being arranged so as to determine, during reception of the second sub-signal, a first control value and store this value in the first memory means, and the control circuit further being embodied so as to read, upon completion of the reception of the second sub-signal, the first control value from the first memory means and store this value in the second memory means.

The length of the second sub-signal is selected so that the first control value, which is known upon completion of the reception of this second sub-signal, corresponds properly to the desired frequency of the oscillator. By storing this first control value in the second memory means, it becomes possible to fall back on this first control value when, during further reception of the reference signal, problems occur which cause the first control value to be no longer reliable.

A further elaboration of the last-mentioned embodiment of the hearing aid in accordance with the invention is characterized in that the reference signal also comprises a third sub-signal, with the control circuit being arranged so as to determine, during reception of the third sub-signal, a second control value and to store this value in the first memory means, and the control circuit further being embodied so as to read, upon completion of the reception of the third sub-signal, the first control value from the second memory means and to store this value in the first memory means.

The third sub-signal is selected so that the end of this signal corresponds to the end of the reference signal. If, after a complete reception of the reference signal, the first control value stored in the second memory means is always copied to the first memory means, a reliable control value is guaranteed which is available in the first memory means at the beginning of the reception of a subsequent reference signal.

These and other aspects of the invention will be apparent from and elucidated with reference to the embodiments described hereinafter.

DETAILED DESCRIPTION OF THE PREFERRED EMBODIMENT

Figure 1:
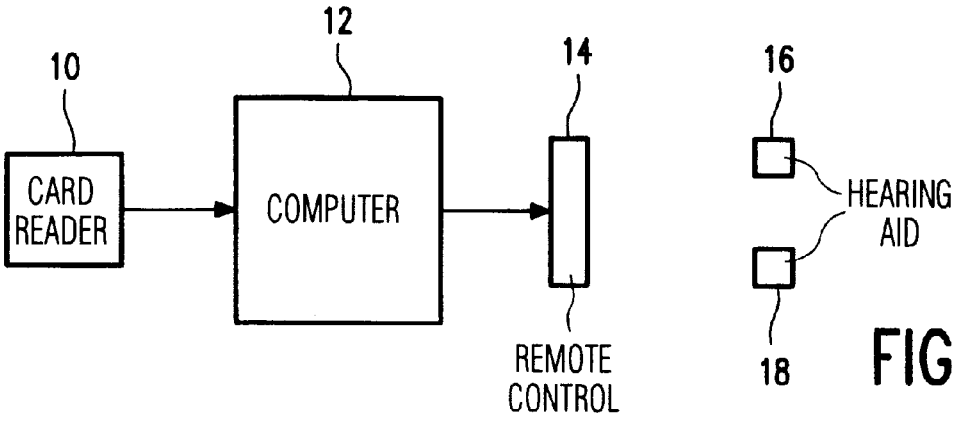
FIG. 1 shows a block diagram of an example of a hearing system comprising a hearing aid in accordance with the invention.

The hearing system shown in FIG. 1 comprises a card reader 10, a computer system 12, a remote control 14 and two hearing aids 16 and 18. The computer system 12 is a device which serves to load at least one hearing algorithm into the remote control 14. A hearing algorithm comprises a set of instructions which can be executed by a programmable processor which is incorporated in the hearing aid 16, 18. By execution of the set of instructions forming a hearing algorithm in the hearing aid 16, 18, a desired transfer function of the hearing aid 16, 18 is realized.

The computer system 12 and the card reader 10 coupled thereto are arranged so as to be used by a hearing-aid fitter, for example, an audiologist. The hearing-aid fitter has a number of smart cards on which hearing algorithms are stored. Each one of these hearing algorithms corresponds to a specific transfer function of the hearing aid 16, 18.

After the hearing-aid fitter has determined the hearing characteristics of an ear of a hearing-impaired patient, the hearing-aid fitter can select, from the available hearing algorithms, a hearing algorithm which is suitable for this ear under specific sound conditions. This means that the hearing-aid fitter selects a hearing algorithm which corresponds to a transfer function of the hearing aid 16, 18, thus enabling the hearing deficiency of the ear demonstrated by the hearing characteristics to be corrected to the extent possible under the above-mentioned sound conditions.

By means of a program which can be executed by the computer system 12, the hearing-aid fitter can, subsequently, read the selected hearing algorithm from the smart card and adapt it. For this purpose, the smart card containing the selected hearing algorithm must first be introduced into the card reader 10. Subsequently, by means of the program the hearing algorithm can be read from the smart card and loaded into the computer system 12. Next, the hearing-aid fitter can adapt the selected hearing algorithm by means of the program so as to achieve a fine adjustment of the transfer function of the hearing aid 16, 18 corresponding to the hearing algorithm.

In general, the above-described process of selecting and adapting hearing algorithms will have to be repeated a number of times by the hearing-aid fitter. Said number is equal to the product of, on the one hand, the number of ears for which the patient requires a hearing aid 16, 18 and, on the other hand, the number of different sound conditions for which an adaptation of the transfer function of the hearing aid 16, 18 is desirable. This can be explained by means of an example. Let us assume that the patient needs a hearing aid 16, 18 for both ears, and that after examination and consultation with the patient it has been decided that setting the transfer function of the hearing aid 16, 18 for two different audio conditions is desirable. This means that, in this example, the hearing-aid fitter has to select and adapt four (=two ears×two sound conditions) hearing algorithms.

The selected and adapted hearing algorithms can subsequently be loaded into the remote control 14 by means of the program. For this purpose, the remote control 14 can be coupled to the computer system 12, for example, by means of a serial connecting cable. After all hearing algorithms have been loaded into the remote control 14, the connection between the remote control 14 and the computer system 12 can be interrupted.

The patient can now control the hearing aid 16, 18 by means of the remote control 14. If necessary, one remote control 14 suffices to control two hearing aids 16, 18.

To control the hearing aids 16, 18, the remote control 14 comprises a transmitter for sending reference or control signals to the hearing aid 16, 18. To receive the reference or control signals, the hearing aid 16, 18 is provided with a suitable receiver.

The reference or control signals may be in the form of infrared signals, ultrasonic sound signals or radio signals. It is alternatively possible to send the reference or control signals from the remote control 14 to the hearing aid 16, 18 via wires.

A number of different functions of the hearing aid 16, 18 can be set by the patient via the remote control 14. First, the patient can control the volume of the hearing aid 16, 18. Second, as the hearing aid 16, 18 may comprise both a microphone and a telephone coil, the patient can select a sound-reception source. In this case, the telephone coil can suitably be used as a sound-reception source in situations in which a special means for inductively transferring acoustic information is available. This is the case, for example, during a telephone call or in a room provided with a ring circuit. The microphone can be used as a sound-reception source in all situations. By means of the remote control 14, the patient can choose the microphone, the telephone coil or the microphone and the telephone coil as a sound-reception source.

And third, the patient can adapt the setting of the hearing aid 16, 18 for use under specific sound conditions. To this end, the patient can select a selection means of the remote control 14 which is coupled to these specific sound conditions, whereafter the associated hearing algorithm or the associated hearing algorithms are sent to the hearing aid 16, 18.

And fourth, the patient can put the hearing aid into a stand-by state. In this state, the hearing aid 16, 18 is in the off-position. In this state, the energy consumption of the hearing aid 16, 18 is minimal, while all settings of the hearing aid 16, 18 are preserved.

Figure 2:
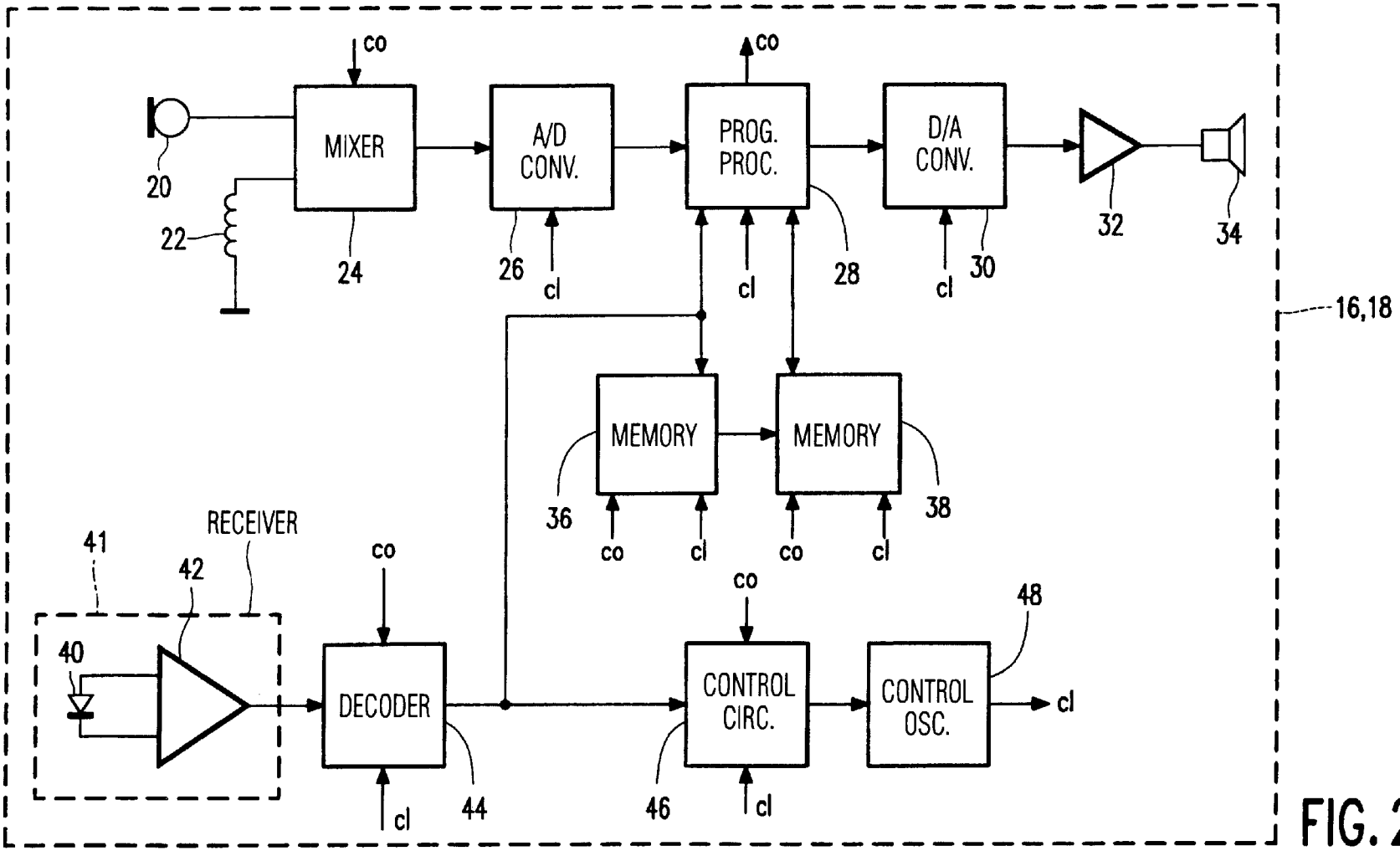
FIG. 2 shows a block diagram of an example of a hearing aid in accordance with the invention.

The hearing aid 16, 18 shown in FIG. 2 comprises a mixer 24 to which a microphone 20 and a telephone coil 22 for receiving sounds are coupled. The sounds received are converted by this microphone 20 and the telephone coil 22 into electric signals which are first amplified in the mixer 24, whereafter one or both electric signals are selected for further processing by an analog-to-digital converter 26. This selection is controlled by a programmable processor 28 via control signals co.

In the analog-to-digital converter 26, the analog electric signal originating from the mixer 24 is converted to a digital signal. Subsequently, this digital signal is processed by the programmable processor 28 and, next, converted back to an analog signal by a digital-to-analog converter 30, whereafter the analog signal is amplified by an output amplifier 32 and, subsequently, converted to sound by an electro-acoustic converter 34.

The operation in which the digital signal is processed by the programmable processor 28 is controlled by a hearing algorithm stored in a first memory means 38. The execution of this hearing algorithm by the programmable processor 28 determines the transfer function of the hearing aid 16, 18. During the execution of the hearing algorithm by the programmable processor 28, intermediate results can be stored in a second memory means 36. Both memory means 36 and 38 are implemented as RAM-memories and are controlled from the programmable processor 28 by means of control signals co.

Reference or control signals originating from a remote control can be received by a receiver 41. In this example, the receiver 41 is implemented so as to receive infrared signals. For this purpose, the receiver 41 comprises a receiving diode 40 which can suitably be used to receive said infrared signals. The receiver 41 further comprises an amplifier 42 which amplifies the infrared signals received by the receiving diode 40.

The reference or control signal received by the receiver 41 is checked and decoded in the decoder 44. The information contained in the reference or control signal received is subsequently sent to the programmable processor 28. The programmable processor 28 checks whether the address contained in the reference or control signal corresponds to the address of the hearing aid 16, 18. This is because the hearing aid 16, 18 has a unique address which is implemented by the presence or absence of a number of connections in the hearing aid 16, 18. If the addresses correspond with each other, the information contained in the reference or control signal can be used for further processing by the programmable processor 28.

By means of the reference or control signal, a hearing algorithm can be sent from the remote control 14 to the hearing aid 16, 18. During reception of such a reference or control signal containing a hearing algorithm, the hearing algorithm is temporarily stored in the second memory means 36 by the programmable processor 28. The hearing algorithm in the second memory means 36 is not copied to the first memory means 38 until the complete hearing algorithm has been properly received and completely stored in the second memory means 36, whereafter the newly received hearing algorithm determines the transfer function of the hearing aid.

The hearing aid 16, 18 in accordance with the invention further comprises a controllable oscillator 48 which generates a clock signal cl for the various digital components. For the proper functioning of the hearing aid 16, 18, it is important that the frequency of the clock signal cl remains within certain limits. However, as a result of variations, for example, in the supply voltage and the temperature, the frequency may extend beyond these limits in the case of the hearing aid 16, 18 in accordance with the invention. To preclude this, the hearing aid 16, 18 also comprises a control circuit 46 which is coupled to the decoder 44 and the controllable oscillator 48. Each time that a reference or control signal is received from the remote control 14, the frequency of the clock signal cl is measured in this control circuit 46 by means of a frequency of the reference or control signal. As the frequency of the reference or control signal is governed directly by the frequency of a crystal incorporated in the remote control 14, the frequency of the reference or control signal can suitably be used as a reference.

If the measurement of the frequency of the clock signal cl reveals that said frequency deviates from a reference frequency, then a control value is determined in the control circuit 46 by means of which the controllable oscillator 48 adjusts the frequency of the clock signal cl.

The controllable oscillator 48 comprises a current-controlled three-inverter ring oscillator, enabling the supply current to determine the frequency of the clock signal cl generated by the controllable oscillator 48. The supply current can be logarithmically programmed in a number of steps. This means that by programming the supply current so as to be one step higher or one step lower, the frequency of the clock signal cl is increased or decreased, respectively, by a fixed percentage.

Figure 3:
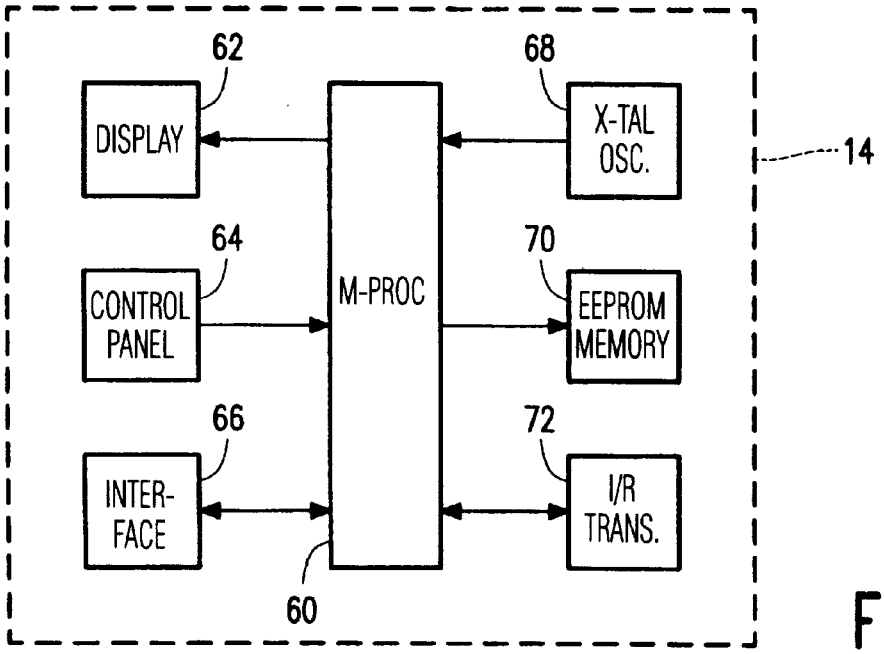
FIG. 3 shows a block diagram of an example of a remote control for controlling a hearing aid in accordance with the invention.

The remote control 14 shown in FIG. 3 comprises a microprocessor 60 to which there is coupled a display 62, a control panel 64, a serial interface 66, a crystal oscillator 68, an infrared transmitter 70 and an EEPROM memory 72. All functions of the remote control 14 are co-ordinated by a program which is carried out by the microprocessor 60. This program is stored in a ROM-memory incorporated in the microprocessor 60. The microprocessor 60 is provided with a clock signal having a stable frequency by means of the crystal oscillator 68.

The EEPROM-memory 72 is constructed so as to store at least two hearing algorithms. From a computer system 12, these hearing algorithms can be loaded into the EEPROM-memory 72 by means of the serial interface 66.

The display 62 can be used to show all kinds of data. For example, it can be used to show the volume level of the hearing aid 16, 18.

The various functions of the remote control can be activated by means of the control panel 64. The control panel 64 comprises a number of buttons by means of which the volume of the hearing aid 16, 18 can be adapted. The control panel 64 further includes a button by means of which the hearing aid 16, 18 can be brought into a stand-by state, and a number of buttons for selecting the sound-reception source (microphone 20 and/or telephone coil 22) of the hearing aids 16, 18. If these buttons are operated, a control signal corresponding to the selected function is sent to the hearing aid 16, 18 via the infrared transmitter 70. Once the hearing aid 16, 18 has received the control signal, the function corresponding to said control signal is activated.

The control panel 64 additionally comprises a number of buttons (selection means) by means of which the hearing aid 16, 18 can be adapted to different sound conditions. If such a button is operated, a hearing algorithm corresponding to this button is read from the EEPROM-memory 72 by the microprocessor 60, whereafter it is sent to the hearing aid 16, 18 via the infrared transmitter 70. In the hearing aid 16, 18, the transfer function of the hearing aid 16, 18 is subsequently determined by the hearing algorithm.

The remote control 14 can suitably be used to control one or two hearing aids 16, 18. If the remote control 14 is used to control a hearing aid 16 and a further hearing aid 18, then, operating the last-mentioned button causes a hearing algorithm corresponding to this button to be sent to the hearing aid 16, whereafter a further hearing algorithm which also corresponds to this button is sent to the further hearing aid 18. This further hearing algorithm does not have to be equal to the hearing algorithm sent to the hearing aid 16. In this manner, the transfer functions of both hearing aids 16, 18 can be adapted to changing sound conditions by means of a single selection means.

Figure 4:
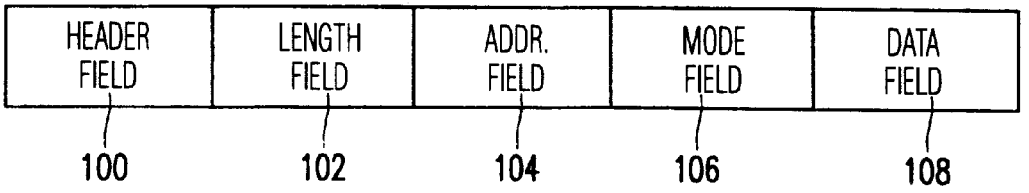
FIG. 4 schematically shows an example of a logical construction of a reference signal or control signal received by a hearing aid in accordance with the invention.

FIG. 4 schematically shows the logical construction of a reference or control signal sent by a remote control 14 and received by a hearing aid 16, 18 in accordance with the invention. The reference or control signal successively comprises a header field 100, a length field 102, an address field 104, a mode field 106 and a data field 108. All these fields comprise a number of information bits. The contents of the header field 100 is the same for all reference or control signals. The hearing aid 16, 18 can distinguish reference or control signals originating from a remote control 14 suited to operate such a hearing aid 16, 18, from other signals originating, for example, from remote controls for television and audio equipment.

The length field 102 includes an indication of the cumulative sum of the number of information bits in the address field 104, the mode field 106 and the data field 108. The number of information bits in the data field 108 is governed by the contents of the mode field 106. By means of the information in the length field 102, it can be determined in the hearing aid 16, 18 whether a reference or control signal has been correctly received.

The address field 104 contains the address of the hearing aid 16, 18 for which the reference or control signal is intended. As each hearing aid 16, 18 has a unique address, it is possible to decide on the basis of the contents of the address field 104 whether the reference or control signal should be subjected to further processing operations or whether further processing is not necessary because the reference or control signal is not intended for this hearing aid 16, 18.

The mode field 106 may comprise one of the following values: program mode, volsource mode or stand-by mode. If the contents of the mode field 106 comprises the program mode, then the data field 108 contains a hearing algorithm. This hearing algorithm is stored in a first memory means 38 by the hearing aid, and is subsequently executed by the programmable processor 28. If the contents of the mode field 106 comprises the volsource mode, then the data field 108 contains information regarding the sound-reception source (microphone 20 and/or telephone coil 22) and volume level to be used. This information is used by the programmable processor 28 to change the setting of the hearing aid 16, 18 in a corresponding manner. If the contents of the mode field 106 contains information as to the stand-by mode, then the contents of the data field 108 is empty. After receiving such a reference or control signal, the hearing aid 16, 18 will be switched into the stand-by state. In this state, the hearing aid 16, 18 is in the off-position. In this state, the energy consumption of the hearing aid 16, 18 is minimal, while all settings of the hearing aid 16, 18 are preserved.

The reference or control signal sent by the remote control 14 and received by the hearing aid 16, 18 consist of a 100% modulated square-wave of 36 kHz. This reference or control signal is coded in such a manner that an information bit is represented by sixteen periods of the reference or control signal.

Figure 5:
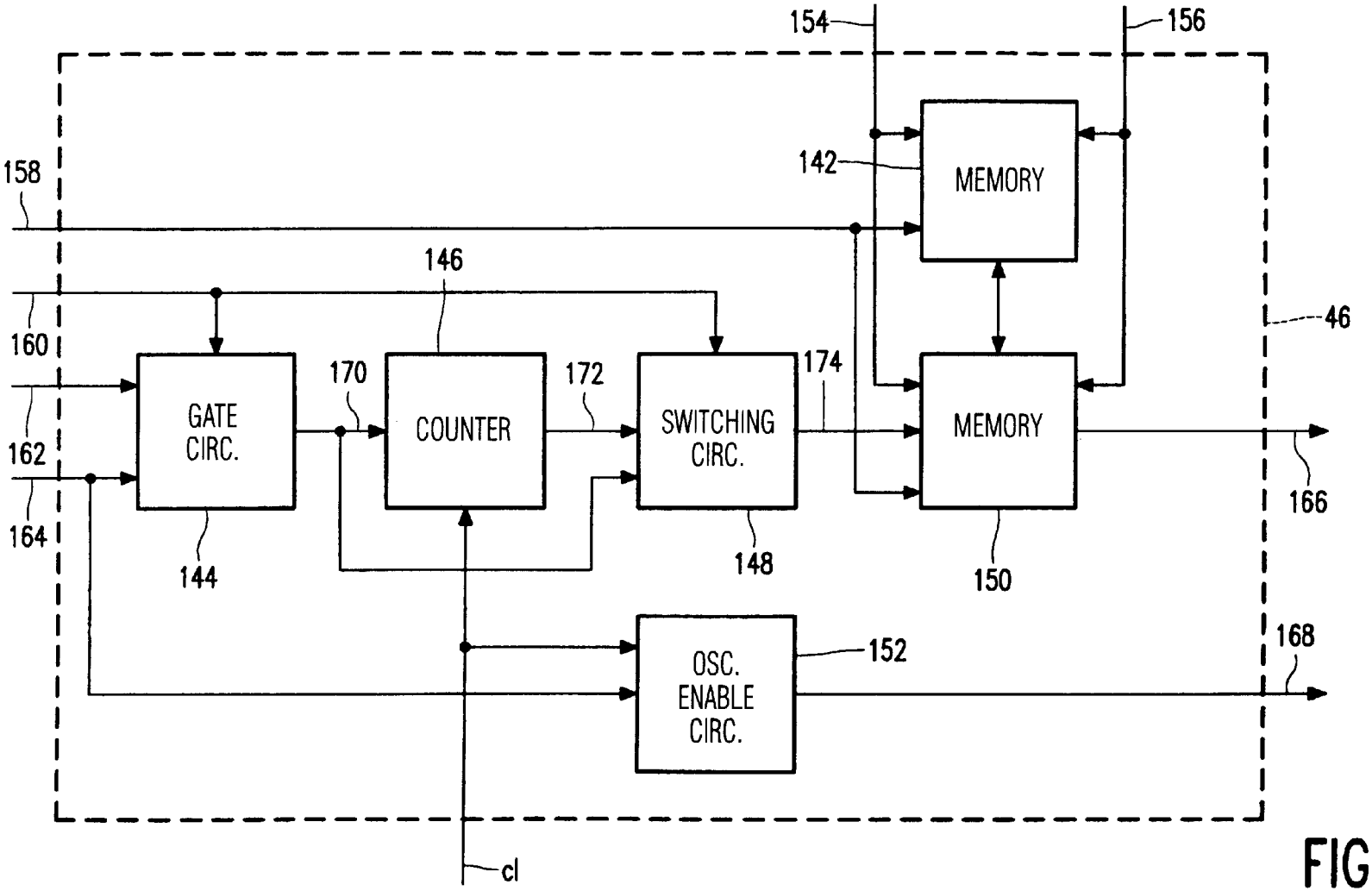
FIG. 5 shows a block diagram of an example of a control circuit for use in a hearing aid in accordance with the invention.

By means of the control circuit 46 shown in FIG. 5, the frequency of the clock signal cl generated by the controllable oscillator 48 will be regulated in such a manner, by means of the reference or control signal received from the remote control 14, that this frequency remains substantially constant despite variations, for example, in the supply voltage and/or temperature.

For this purpose, the control circuit 46 is connected, by means of a number of input and output signals, to the decoder 44, the controllable oscillator 48 and the programmable processor 28. The input signals message-end 158, state 160, envelope 162 and reference or control signal 164 originate from the decoder 44. The clock signal cl originates from the controllable oscillator 48 and address-ok 154 and reset 156 originate from the programmable processor 28. The controllable oscillator 48 can be regulated by the control circuit 46 by means of the following output signals: control value 166 and oscillator-enable 168.

The envelope signal 162 is derived from the reference or control signal 164 by the decoder 44 and comprises the envelope of the reference or control signal 164. To reduce the sensitivity to interference in the reference or control signal 164, this envelope signal 162 is used, by the decoder 44, to decode and check the information contained in the reference or control signal 164.

The message-end signal 158 indicates that the reception of the reference or control signal 164 has ended.

By means of the state-signal 160, the control circuit 46 can be switched between a first and a second state. The first state must be used if the frequency of the clock signal cl exhibits a relatively large deviation from a desired frequency. In this first state, the control circuit 46 can relatively rapidly control the frequency of the clock signal cl in relatively large first frequency steps. The second state must be used if the frequency of the clock signal cl is already close to the desired frequency. In this second state, the control circuit 46 can relatively slowly control the frequency of the clock signal cl in relatively small second frequency steps.

A gate circuit 144 controls a counter 146 by means of a gate signal 170. When the gate signal 170 changes from low to high, the counter 146 is set at zero. As long as the gate signal 170 remains high, the periods of the clock signal cl are counted. When the gate signal 170 changes from high to low, a known period of time has elapsed, and the value of the counter 146 can be evaluated. The results of this evaluation are sent to a switching block 148 by means of a counter-evaluation signal 172. On the basis of this counter-evaluation signal 172, a control signal 174 is determined in the switching block 148. Subsequently, the control value 166 stored in a first memory means 150 is adapted on the basis of this control signal 174. Finally, the frequency of the clock signal cl is determined by the controllable oscillator on the basis of this control value 166. The control value 166 can be set in a number of steps, for example 32.

If the control circuit 46 is switched into the first state, the gate signal 170 is kept high by the gate circuit 144 during one period of the reference or control signal 164. If the evaluation of the value of the counter 146 shows that the frequency of the clock signal cl must be adapted, then an adaptation of the control value 166 of the order of two steps is carried out immediately.

If the control circuit 46 is switched into the second state, the gate signal 170 is kept high by the gate circuit 144 during four periods of the reference or control signal 164. An adaptation of the control value 166 of the order of one step does not take place until the frequency has been found to deviate during two successive measurements.

The header field 100, the length field 102 and the address field 104 together form a second sub-signal of the reference or control signal 164. During reception of this second sub-signal, a first control value is determined by the control circuit 46 in the manner described hereinabove. This first control value is stored in the first memory means 150. After the second sub-signal has been received, the programmable processor 28 checks whether the address contained in the address field 104 corresponds to the address of the hearing aid 16, 18. If so, the address-ok-signal 154 is activated by the programmable processor 28. As a result, the first control value is read from the first memory means 150 by the control circuit 46 and stored in the second memory means 142.

The mode field 106 and the data field 108 together form a third sub-signal of the reference or control signal 164. During reception of this third sub-signal, a second control value is determined by the control circuit 46 in the manner described hereinabove. This second control value is stored in the first memory means 150. After this third sub-signal has been received, the message-end-signal 158 is activated by the decoder 44. As a result, the first control value is read from the second memory means 142 by the control circuit 46 and stored in the first memory means 150.

By means of the reset-signal 156, the programmable processor 28 indicates that a battery is put into the hearing aid 16, 18. As, in this situation, the control value stored in the first memory means 150 is not reliable, this control value is initialized by the control circuit 46.

At the beginning of the reception of the reference or control signal 164, it is uncertain whether the frequency of the clock signal cl is close to the desired frequency. For this reason, at the beginning of the reception of the reference or control signal 164 (and hence also at the beginning of the reception of the header field 100), the control circuit 46 is switched into the first state. As the length of the header field 100 is chosen so as to be sufficient, it is certain that after reception of the header field 100, the frequency of the clock signal cl is close to the desired frequency. Consequently, after reception of the header field 100, the control circuit 46 can be switched into the second state. In this context, the header field 100 of the reference or control signal 164 is equal to the first sub-signal.

If a reference or control signal 164 is sent to the hearing aid 16, 18, it is not always certain that a clock signal cl will be generated by the controllable oscillator 48. This can be attributed to the fact that the hearing aid 16, 18 may still be in the stand-by state. For properly processing the reference or control signal 164, however, a clock signal cl is indispensable. To solve this problem, the control circuit 46 is provided with a circuit 152 for generating the oscillator-enable-signal 168. This circuit 152 activates the oscillator-enable-signal 168 at the first rising edge of the reference or control signal 164 in an asynchronous manner. As a result, the oscillator is activated (if it was still inactive) and a clock signal cl is generated. In order to be sure that the clock signal cl is active throughout the reception of the reference or control signal 164, the oscillator-enable-signal 168 is activated during a sufficient number (for example 1024) of periods of the clock signal cl by the circuit 152.

Figure 6:
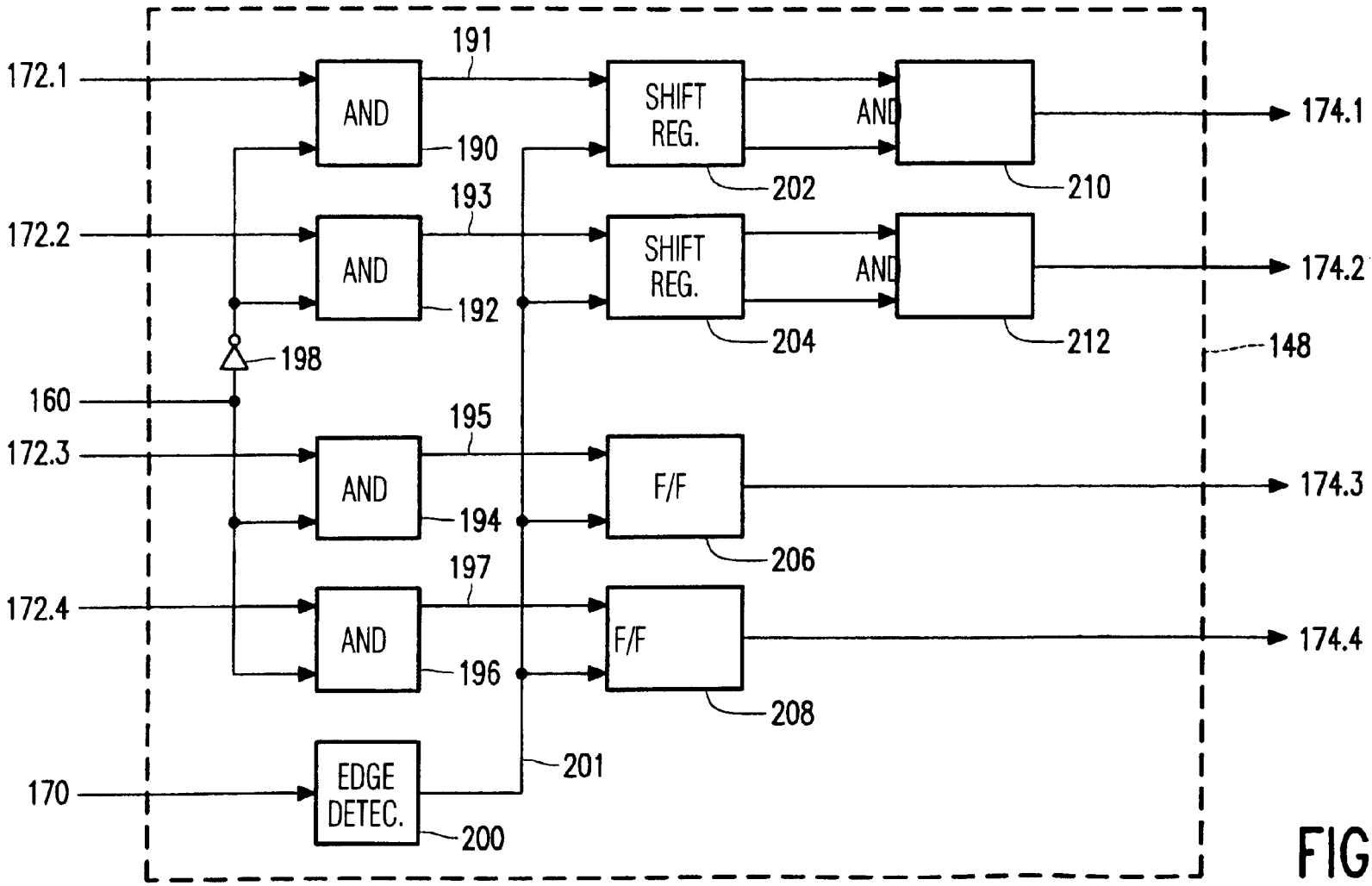
FIG. 6 shows a block diagram of an example of a switching block for use in a hearing aid in accordance with the invention.

The block diagram of a switching block 148 shown in FIG. 6 forms part of the control circuit 46. In the switching block 148, the control signal 174 must be determined on the basis of the counter-evaluation signal 172 originating from the counter 146. The counter-evaluation signal 172 comprises an overshoot-1 signal 172.1, an undershoot-1 signal 172.2, an overshoot-2 signal 172.3 and an undershoot-2 signal 172.4. The control signal 174 comprises a 1-decrease signal 174.1, a 1-increase signal 174.2, a 2-decrease signal 174.3 and a 2-increase signal 174.4.

The switching block 148 can be switched into the first and the second state by means of the state-signal 160. As regards the signals introduced in the preceding paragraph, the signals whose designation includes the reference numeral 1 are important to the second state, while the signals whose designation includes the reference numeral 2 are important to the first state.

Four AND-gates 190, 192, 194 and 196 and an inverter 198 jointly ensure that the input signals 172.1 through 172.4 are used only in the state for which they are intended.

If in detector 200 a falling edge is detected in the gate signal 170, a take-over signal 201 is supplied at an output of the detector 200. As a result thereof, the 2-bit shift registers 202 and 204 and the flip-flops 206 and 208 take over the value of, respectively, the signals 191, 193, 195 and 197.

The overshoot-1 signal 172.1 indicates that the value of the counter 146 in the second state is too high. At every falling edge of the gate signal 170, this overshoot-1 signal 172.1 is clocked into the 2-bit shift register 202 (as described in the preceding paragraph) via the AND-gate 190. In this manner, the 2-bit shift register 202 contains the two values of the overshoot-1 signal 172.1 which were taken over last. These values are used to determine the 1-decrease signal 174.1 by means of an AND-gate 210. As a result, the value of the 1-decrease signal 174.1 is active only if an active value is taken over in the 2-bit shift register 202 two times in a row. If the 1-decrease signal 174.1 is active, the control value 166 stored in the first memory means 150 is reduced by one by the control circuit 46. Indirectly, this causes the frequency of the clock signal cl to be regulated down by one step The undershoot-1 signal 172.2 indicates that the value of the counter 146 in the second state is too low. Via the AND-gate 192, this undershoot-1 signal 172.2 is clocked into the 2-bit shift register 204 at every falling edge of the gate signal 170. As a result, the 2-bit shift register 204 contains the two values of the undershoot-1 signal 172.2 which were taken over last. These values are subsequently used to determine the 1-increase signal 174.2 by means of an AND-gate 212. The value of this 1-increase signal 174.2 is active only if an active value of the undershoot-1 signal 172.2 is taken over in the 2-bit shift register 204 twice in a row. If the 1-increase signal 174.2 is active, the control value 166 stored in the first memory means 150 is increased by one by the control circuit 46. As a result, the frequency of the clock signal cl is indirectly regulated up by one step.

By virtue of the above-described construction, in the second state, a relatively small adaptation of the control value 166 does not take place until an equal, deviating frequency has been found during two successive measurements.

The overshoot-2 signal 172.3 indicates that the value of the counter 146 in the first state is too high. This overshoot-2 signal 172.3 is clocked into the flip-flop 206 via the AND-gate 194 at every falling edge of the gate signal 170. As a result, the 2-decrease signal 174.3 is determined by the value of the overshoot-2 signal 172.3 taken over in the flip-flop 206. If the 2-decrease signal 174.3 is active, the control value 166 stored in the first memory means 150 is reduced by two by the control circuit 46. As a result, the frequency of the clock signal cl is indirectly regulated down by two steps.

The undershoot-2 signal 172.4 indicates that the value of the counter 146 in the first state is too low. This undershoot-2 signal 172.4 is clocked into the flip-flop 208 via the AND-gate 196 at every falling edge of the gate signal 170. As a result, the 2-increase signal 174.4 is determined by the value of the undershoot-2 signal 172.4 taken over in the flip-flop 208. If the 2-increase signal 174.4 is active, the control value 166 stored in the first memory means 150 is increased by two by the control circuit 46. As a result, the frequency of the clock signal cl is indirectly regulated up by two steps.

As a result of the above construction, a relatively large adaptation of the control value 166 is carried out directly in the first state if a deviation in frequency is found during a measurement.

What is claimed is:

1. A hearing aid comprising: a sound transducer, amplifier means and an electro/acoustic transducer coupled in tandem, a controllable oscillator and a control circuit coupled thereto, a receiver for receiving a reference signal from a remote control independently of the sound transducer, the control circuit also being coupled to the receiver and being operative so as to regulate the frequency of the oscillator by means of the reference signal received by the receiver.

2. A hearing aid as claimed in claim 1, wherein the control circuit can be switched between at least a first state and a second state, said control circuit being arranged so as to change, in the first state, the oscillator frequency in first frequency steps and, in the second state, in second frequency steps, the first frequency steps being larger than the second frequency steps.

3. A hearing aid as claimed in claim 1, wherein the oscillator comprises a ring oscillator with an adjustable supply-current.

4. A hearing aid comprising: a controllable oscillator and a control circuit coupled thereto, a receiver for receiving a reference signal from a remote control, the control circuit also being coupled to the receiver and being operative so as to regulate the frequency of the oscillator by means of the reference signal received by the receiver, wherein the control circuit can be switched between at least a first state and a second state, said control circuit being arranged so as to change, in the first state, the oscillator frequency in first frequency steps and, in the second state, in second frequency steps, the first frequency steps being larger than the second frequency steps, and wherein the reference signal comprises a first sub-signal, with the control circuit being switched into the first state during reception of the first sub-signal, and, upon completion of the reception of the first sub-signal, said control circuit being switched into the second state.

5. A hearing aid as claimed in claim 4, wherein the control circuit further comprises first and second memory means with said memory means arranged to contain a control value corresponding to a frequency of the oscillator, and the reference signal further comprises a second sub-signal, said control circuit being arranged so as to determine, during reception of the second sub-signal, a first control value and to store said first control value in the first memory means, and said control circuit is further arranged so as to read, upon completion of the reception of the second sub-signal, the first control value from the first memory means and to store said first control value in the second memory means.

6. A hearing aid as claimed in claim 5, wherein the reference signal also comprises a third sub-signal, the control circuit being arranged so as to determine a second control value during reception of the third sub-signal, and to store said second control value in the first memory means, and the control circuit is further arranged so as to read the first control value from the second memory means after reception of the third sub-signal, and to store said value in the first memory means.

7. A hearing aid as claimed in claim 4, wherein the frequency of the oscillator can be changed step-wise in accordance with a logarithmic series.

8. A hearing aid comprising: a controllable oscillator and a control circuit coupled thereto, a receiver for receiving a reference signal from a remote control, the control circuit also being coupled to the receiver and being operative so as to regulate the frequency of the oscillator by means of the reference signal received by the receiver, and wherein the frequency of the oscillator can be changed step-wise in accordance with a logarithmic series.

9. A programmable hearing aid comprising:

a sound transducer, an electro/acoustic transducer, a first signal path including amplifier means coupling the sound transducer to the electro/acoustic transducer, a programmable processor for controlling at least one operating parameter in said first signal path, a second signal path including a receiver, a control circuit and a frequency controllable oscillator that derives a clock signal for the programmable processor, wherein said receiver receives a reference signal from a remote control unit, and said control circuit regulates the clock signal frequency of the oscillator on the basis of the reference signal received by the receiver.

10. A programmable hearing aid as claimed in claim 9 wherein the reference signal is a frequency stable signal whose frequency is fixed by a crystal oscillator in the remote control unit.

11. A programmable hearing aid as claimed in claim 9 wherein said receiver receives said reference signal independently of the first signal path.

12. A programmable hearing aid comprising:

a sound transducer, an electro/acoustic transducer, a first signal path including amplifier means coupling the sound transducer to the electro/acoustic transducer, a programmable processor for controlling at least one operating parameter in said first signal path, a second signal path including a receiver, a control circuit and a frequency controllable oscillator that derives a clock signal for the programmable processor, wherein said receiver receives a reference signal from a remote control unit, and said control circuit regulates the clock signal frequency of the oscillator on the basis of the reference signal received by the receiver, and wherein the reference signal is a wireless digital signal and the control circuit is switchable between first and second states as a function of a difference in frequency between the clock signal frequency and the frequency of the received referenced signal.

13. A programmable hearing aid as claimed in claim 12 wherein, when the control circuit is in said first state, it controls the oscillator clock frequency in first frequency steps and when it is in the second state it controls the oscillator frequency in second frequency steps, the first frequency steps being greater than the second frequency steps.

14. A programmable hearing aid as claimed in claim 12 wherein the reference signal comprises a first sub-signal whereby the control circuit is switched into the first state during reception of the first sub-signal, and is switched into the second state when reception of the first sub-signal is completed.

15. A programmable hearing aid comprising:

a sound transducer, an electro/acoustic transducer, a first signal path including amplifier means coupling the sound transducer to the electro/acoustic transducer, a programmable processor for controlling at least one operating parameter in said first signal path, a second signal path including a receiver, a control circuit and a frequency controllable oscillator that derives a clock signal for the programmable processor, wherein said receiver receives a reference signal from a remote control unit, and said control circuit regulates the clock signal frequency of the oscillator on the basis of the reference signal received by the receiver, and wherein the control circuit further comprises, coupled in tandem to said receiver, a gate circuit, a counter, a switching circuit and a first memory means, and a second memory means is coupled to the first memory means, wherein the counter receives the clock signal of the frequency controllable oscillator.

16. A programmable hearing aid as claimed in claim 15 wherein the control circuit is switchable between first and second states and the gate circuit has input means which receive a state signal and said reference signal.

17. A programmable hearing aid comprising:

a sound transducer, an electro/acoustic transducer, a first signal path including amplifier means coupling the sound transducer to the electro/acoustic transducer, a programmable processor for controlling at least one operating parameter in said first signal path, a second signal path including a receiver, a control circuit and a frequency controllable oscillator that derives a clock signal for control of the programmable processor and the control circuit, wherein said receiver receives a reference signal from a remote control unit, and said control circuit regulates the clock signal frequency of the oscillator on the basis of the reference signal received by the receiver.

* * * * *